United States Patent [19]

Porucznik et al.

[11] Patent Number: 4,782,594

[45] Date of Patent: Nov. 8, 1988

[54] CAN OPENERS

[75] Inventors: Paul Porucznik, Kennington; Keith Longstaff, Wantage, both of England

[73] Assignee: Metal Box Limited, Berkshire, England

[21] Appl. No.: 154,496

[22] Filed: Feb. 4, 1988

Related U.S. Application Data

[63] Continuation of Ser. No. 817,743, filed as PCT GB85/00126, Mar. 29, 1985 published as WO85/04645, Oct. 24, 1985 abandoned.

[30] Foreign Application Priority Data

Apr. 5, 1984 [GB] United Kingdom ..... 8408798

[51] Int. Cl.[4] ..... B26B 19/00

[52] U.S. Cl. ..... 30/417; 30/418; 30/422; 30/424

[58] Field of Search ..... 30/417, 418, 422, 424

[56] References Cited

U.S. PATENT DOCUMENTS 2,462,416 2/1949 Nelson .
3,510,941 5/1970 Fyfe ..... 30/417

FOREIGN PATENT DOCUMENTS 155066 2/1953 Sweden .
155668 4/1954 Sweden .
1175575 12/1969 United Kingdom .
1252374 11/1971 United Kingdom .
2050289 6/1979 United Kingdom .
2107424 10/1981 United Kingdom .

OTHER PUBLICATIONS

62176 Taiwan Utility Model, Multipurpose Can Opener, Jan. 31, 1973.

*Primary Examiner*—E. R. Kazenske
*Assistant Examiner*—Willmon Fridie, Jr.
*Attorney, Agent, or Firm*—Christie, Parker & Hale

[57] ABSTRACT

In a can opener having a traction wheel (18) for driving the end seam (26) of a can past the opener, and a cutter wheel (16) for severing the outer seaming wall of the seam, the axes (36,38) of the wheels being mutually perpendicular, the working parts are carried in a common cartridge (58) of metal, mounted removably in the housing (10) of the opener, the cutter wheel and its spindle (74) being integral with each other and mounted in a separate bearing cup (66) fixed in the body (60) of the cartridge and having a thrust bearing (68) remote from the cutter wheel. The housing carries a projecting abutment (54) having a forwardly curved seam-engaging surface which enables a variety of shapes and sizes of cans to be opened.

19 Claims, 5 Drawing Sheets

CAN OPENERS

CROSS REFERENCE TO RELATED APPLICATIONS

This is a continuation of application Ser. No. 817,743, filed as PCT GB85/00126, Mar. 29, 1985 published as WO85/04645, Oct. 24, 1985, now abandoned.

This invention relates to can openers of the kind comprising: a housing; a cutter member comprising a cutter wheel having a circumferential cutting edge for severing the seaming wall of a double end seam of a can; a traction wheel, having a peripheral first surface parallel to the traction wheel axis for engaging the top of the seam and a second surface diverging outwardly from the first surface, for engaging a chuck wall of the seam, the wheels being rotatably mounted in the housing with their axes substantially perpendicular to each other; actuating means for driving one of the wheels; a first abutment projecting from the housing behind the wheels (with respect to the direction of movement of the housing relative to the seam during cutting), the first abutment having a seam-engaging surface for engaging the top of the seam to tilt the housing about the traction wheel axis when the said first surface is engaged with the top of the seam, whereby to determine an angle of dive greater than zero between the planes of the cutting edge and the top of the seam; and a second abutment for engaging the side of the can during cutting.

Such a can opener will be referred to herein as a "can opener of the kind specified".

An earlier proposal for a can opener of the kind specified was described in our United Kingdom patent specification No. 1 175 575. In that can opener, the cutter wheel was mounted on a separate cutter wheel spindle rotatably mounted in a cylindrical hole formed in the housing itself, the arrangement being such that the cutter wheel had to be assembled on to its spindle in situ. This is a difficult operation to perform in a manner such as to guarantee the integrity of the fitting, and there is a considerable danger of the cutter wheel becoming loose on the spindle in the course of time. It is also difficult to inspect for fracture or other damage, and difficult to assemble in such a manner as to guarantee the correct relative orientation as between the axes of the cutter wheel and traction wheel.

Furthermore, the back or lower face of the cutter wheel undergoes substantial axial thrust during the cutting operation. For this reason the opening in the housing in which the cutter wheel lies is limited in size, since the thrust face of the cutter wheel must be allowed to bear on the bottom of this opening. This in turn encourages detrimental accumulation of metal debris and other matter, such as food particles, in the opening. Because of the thrust forces which force the back face of the cutter wheel down against the bottom of the opening, substantial friction forces are set up between the cutter wheel itself and the housing, thus increasing the torque necessary to operate the can opener.

Another feature described in our U.K. patent specification No. 1 175 575 is the above-mentioned first abutment in the form of a cylindrical pin projecting perpendicularly from the side of the housing, this being normally adequate for use with cylindrical cans.

It is known to manufacture the housing of the can opener of United Kingdom patent No. 1 175 575 from glass-filled plastics material, so as to enable the can opener to be made (generally as described in the specification of that patent) with the cutter wheel spindle and the traction wheel spindle mounted in holes formed in the housing itself. The can opener cannot however be readily dismantled for cleaning or for replacement of faulty parts, and has often been found to have an undesirably short useful life.

In order to function satisfactorily, a can opener of the kind specified is a precision instrument; nevertheless when a component becomes worn or damaged it has not hitherto been possible for the opener to be readily dismantled to replace the component with a new one.

According to the invention, in a can opener of the kind specified, the cutter member is rotatably mounted in a bearing member having a simple thrust surface, on which a corresponding terminal thrust surface of the cutter member bears.

Preferably the terminal thrust surface (being axially offset from the cutter wheel) is the only non-axial surface of the cutter member in contact with any other part of the can opener, whereby all axial thrust imposed on the cutter wheel is transmitted through said thrust surfaces. The cutter member preferably comprises a spindle coaxial and integral with the cutter wheel, the terminal thrust surface being formed on the free end of the spindle remote from the axis of the traction wheel.

The bearing member is preferably in the form of a metallic cup.

Each of the said thrust surfaces preferably has a cross-sectional area equal to a major fraction of the axially-projected cross-sectional area of the cutter wheel.

According to a preferred feature of the invention, the can opener includes a cartridge sungly mounted in the housing, the cutter member, traction wheel, and bearing member all being carried by the body of the cartridge. Preferably, the cartridge is replaceably removable from the housing, and has means whereby the cutter member can then be removed from the cartridge for replacement. It is convenient and advantageous to provide that the bearing member for the cutter member is a separate member mounted in the cartridge body. Then, where the bearing member is a separate member mounted in the cartridge body, that bearing member is preferably mounted in an aperture in the cartridge open at an external surface of the latter, the cartridge having a knock-out hole to enable the bearing member and cutter member to be removed together from the cartridge after removal of the traction wheel. In this way, the can opener can be made such that it is readily able to be dismantled for cleaning, servicing or repair.

The bearing member and the cartridge may or may not be of the same metal or alloy as each other. The arrangement whereby the working parts are mounted in a separate cartridge, insertable into the housing, has the advantage of enabling the working parts to be assembled together under conditions more favourable, as to both ease of assembly and accuracy, than is the case where the traction wheel and cutter wheel are separately assembled into the housing. The provision of a separate bearing member for the cutter member enables the latter and its bearing member to be preassembled together, and then fitted from the outside into the cartridge before the latter is itself fitted to the housing.

The cutter wheel may include an integral, generally-cylindrical portion coaxial with and adjacent to, the cutting edge, but of a diameter smaller than that of the cutting edge, for limiting the depth of penetration of the cutting edge into the seaming wall. This depth-limiting feature, being provided immediately adjacent to the cutting edge, offers positive and accurate control of the depth of cut in a manner which tends to reduce or eliminate the formation of slivers of shards of metal, or metal dust. It is also found to facilitate, during the cutting operation, lifting the cutter wheel past the longitudinal side seam of a can of the built-up kind, having such a seam.

In a preferred feature of the invention, the seam-engaging surface of the first abutment is so shaped as to span a zone such as to define a multiplicity of possible points of contact at different distances from the traction wheel axis and at different distances from the housing. Such an abutment offers considerable range, in terms of both direction and length, in the vectors joining the point of contact, at any given instant during the can opening operation, of the traction wheel with the can seam, and the point at which another part of the can seam engages the first abutment. This in turn enables the can opener to deal readily with cans of greatly different sizes and shapes, for example small cylindrical cans as well as large cylindrical cans; or cans of irregular shape, such as those which are generally rectangular but with sharply-rounded corners.

The seam-engaging surface of the first abutment is preferably generally curved outwardly and forwardly from the housing towards the axis of the traction wheel.

The first abutment may take any one of a number of forms, for example that of a fin, or of a curved pin cantilevered from the housing.

The divergent second surface of the traction wheel defines a first cone angle with the traction wheel axis, from the junction of the said first and second surfaces of the traction wheel, the second surface being relieved by a bevelled portion, defining a second cone angle smaller than the first cone angle, the bevelled portion terminating at the end of the second surface remote from said junction. This arrangement can considerably improve the reliability of the engagement of the can seam by the traction wheel.

A can opener according to the invention will now be described, by way of example only, with reference to the drawings of this Application, in which.

Figure 1:
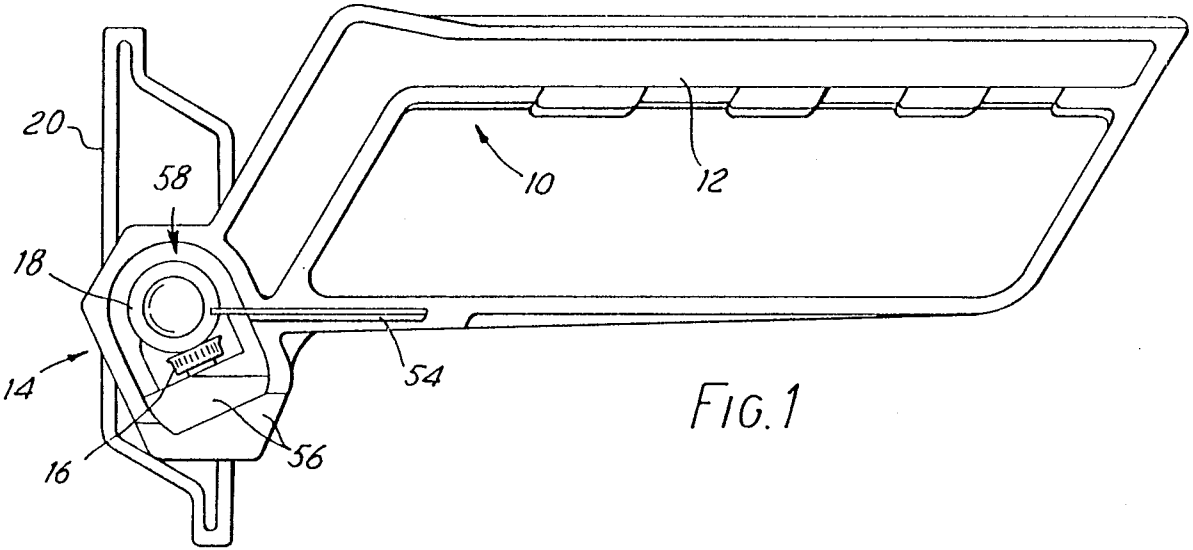
FIG. 1 is a side elevation of the can opener.
Figure 2:
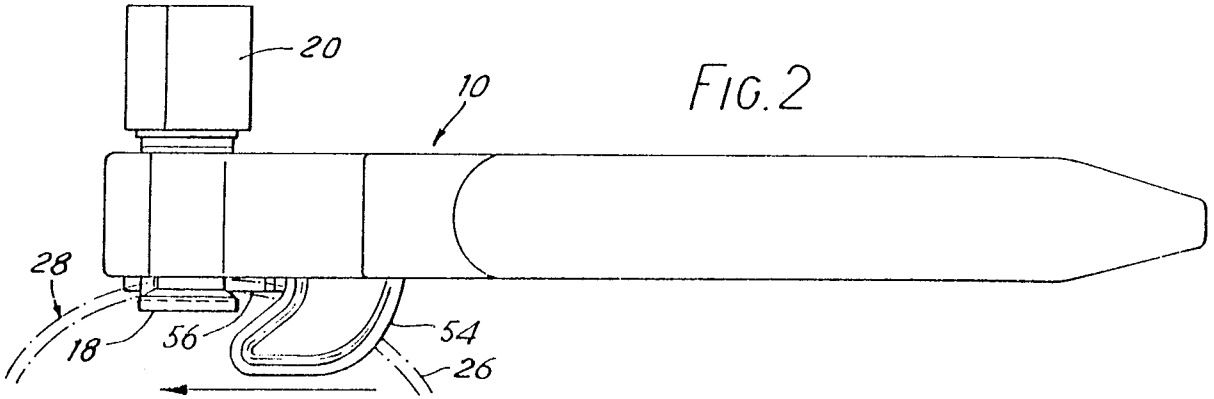
FIG. 2 is a plan view of the same opener.

Referring first to FIGS. 1 and 2, the can opener comprises a housing 10, formed in one piece and including a handle 12, by which the can opener is held in the hand. At the leading (left-hand) end of the housing 10 is a working head 14, which includes a cutter wheel 16, having a circumferential cutting edge 22, and a traction wheel 18, both rotatably mounted, with their axes 36 and 38, respectively, perpendicular to each other, in the housing 10, in the manner to be described hereinafter. The traction wheel 18 is manually rotatable about its own axis by means of a butterfly key 20 mounted at the side of the working head 14.

Figure 3:
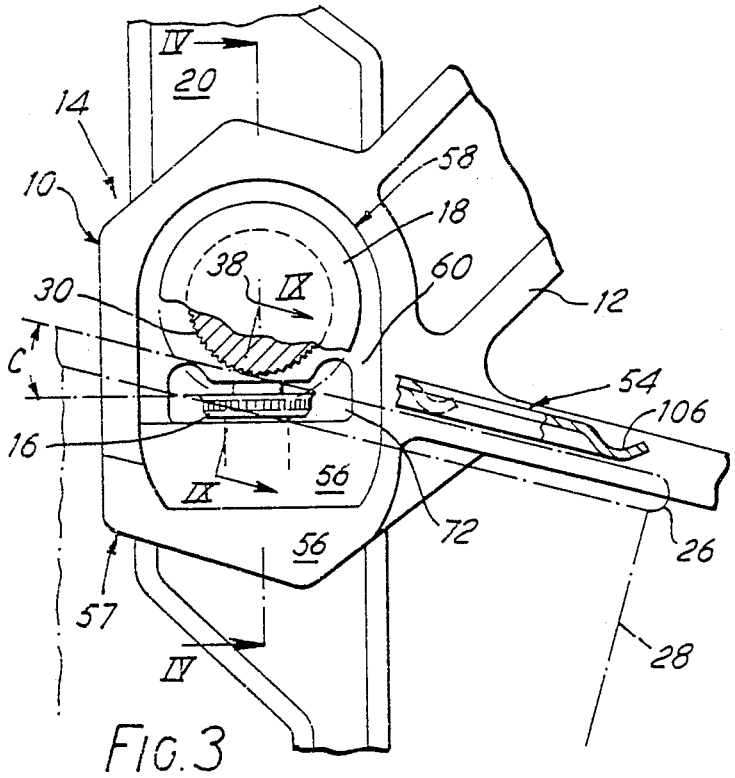
FIG. 3 is an enlarged side elevation showing the working head of the can opener and the orientation of a can relative to the working head during a cutting operation.

A metal can 28 (FIGS. 2 to 4) has a double end seam 26 including a cover hook 94 (FIG. 10) which includes a chuck wall 34 and a seaming wall 24, the latter being the radially outermost part of the seam. It is the wall 24 that is severed by the can opener, by means of the cutting edge 22, FIG. 10. The direction of movement of the housing 10 relative to the can seam 26 during a cutting operation is indicated by the arrow in FIG. 2. Considered with respect to this direction, a first abutment, carried by the housing, projects from the housing behind the traction wheel 18 and cutter wheel 16. The first abutment in this embodiment is a reaction fin 54, which engages the top of the can seam as indicated in FIG. 3. This causes the housing 10 to be tilted about the traction wheel axis 38 when the cylindrical surface 30 of the traction wheel is itself engaged with the top of the seam 26. A second abutment 56 is also provided for engaging the side of the can 28 during the cutting operation.

The tilting action mentioned above determines the angle of dive, C in FIG. 3, between the plane of the cutting edge 22 of the cutter wheel and the plane of the top of the seam. This angle is greater than zero. It is well established that, in a rotary can opener of the general kind which cuts through the seaming wall of a can end double seam, and where the axes of the cutter and traction wheels are mutually perpendicular correct choice of the angle of dive is important to enable satisfactory performance to be obtained. In this example this angle is 15°.

The working head 14 comprises a hollow portion 57 of the housing, open at both ends, and a cartridge 58 which fits snugly (and preferably removably) within the hollow portion 57, and which comprises a cartridge body 60 made of metal, which is preferably a suitable high load-bearing, low-distortion alloy. The body 60 has a through bore 62, terminating at an external thrust surface 61 formed on the body 60. Below the bore 62, and generally parallel to it, a cutter wheel chamber 72 is formed through the body 60, being open at both its ends. The body 60 has a second bore 64, accurately formed with its axis co-planar with, and at right angles to, the axis of the bore 62. In the second bore 64 there is fitted a generally-cylindrical bearing cup 66, made of metal which is again preferably a suitable high load-bearing, low-distortion alloy (though not necessarily the same alloy as that of the cartridge body). The cup 66 is closed at the end furthest from the bore 62, this end having a flat thrust surface 68.

The cartridge body 60 also has a short bore 70 coaxial with the bore 64 and connecting the bore 62 with the cutter wheel chamber 72; and a knock-out hole 102 aligned with the bore 70 so that the bores 64 and 70, with the hole 102, constitute a diametral passage open at both ends.

The second (side) abutment 56 consists partly of a projection of the housing portion 57, and partly of an integral projection of the cartridge body 60.

Figure 7:
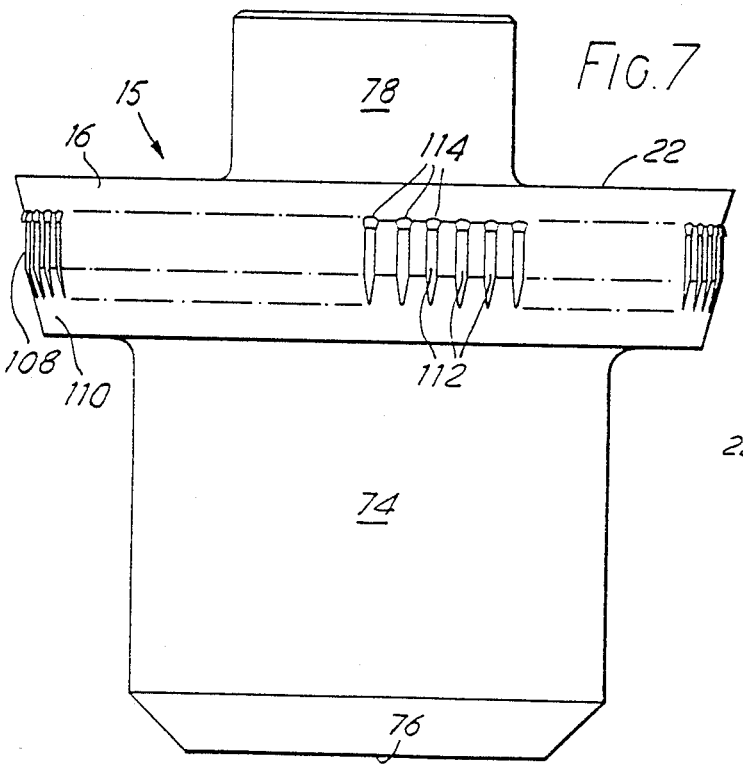
FIG. 7 is a magnified outside elevation of the cutter wheel.
Figure 8:
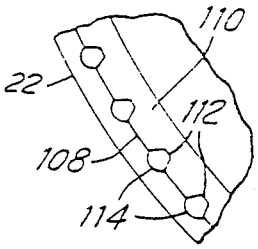
FIG. 8 is an inverted plan view of part of the edge of the cutter wheel, on an even larger scale than FIG. 7.
Figure 10:
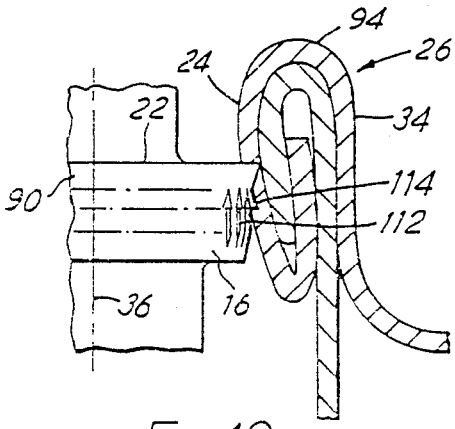
FIG. 10 illustrates how the cutter wheel cuts a can seam.

The cutter wheel 16, shown in FIGS. 7, 8 and 10, is part of a cutter member 15 and is in the form of a cylinder 106 flared outwardly at the top of terminate in the cutting edge 22, and preferably (but optionally) having a frusto-conical lower portion 110. The cylinder 108 has a multitude of axial flutes 112, preferably formed by a broaching operation so that each flute terminates at its upper end in a small projecting tooth 114. FIG. 10 shows the operation of the cutter wheel 16, in which frictional rolling contact between it and the seam wall 24 is assisted by the flutes 112 and teeth 114.

Figure 4:
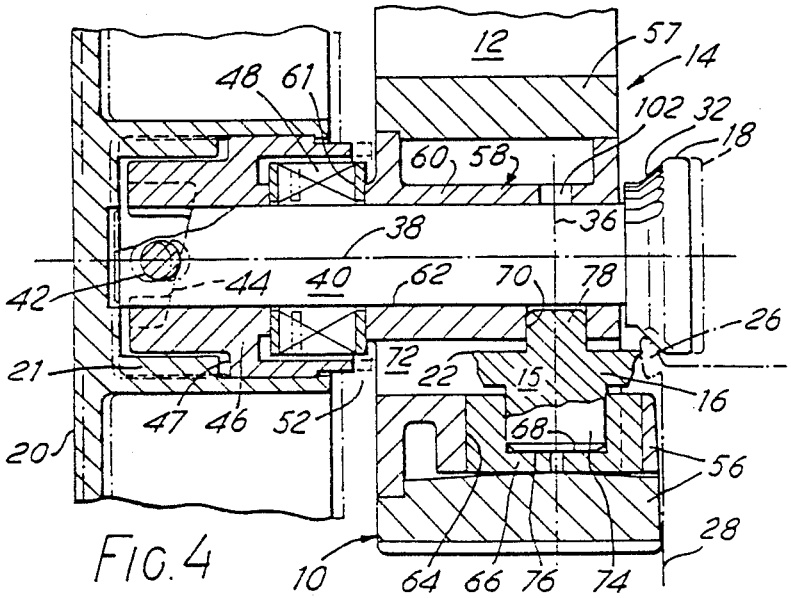
FIG. 4 is a sectional view taken on the line IV—IV in FIG. 3.

The cutter member 15 has an integral and coaxial spindle 74 which is freely rotatable in the bore of the bearing cup 66, the free end of the spindle 74 has a flat terminal thrust surface 76, which is thereby axially offset from the cutter wheel 16, and which bears upon the thrust surface 68, FIG. 4. The cutter member 15 also has an integral, coaxial trunnion 78 which is journalled in the short bore 70, FIG. 4. When the thrust surfaces 68 and 76 are in mutual engagement, the cutter wheel 16 is out of contact with both the cartridge housing 60 and the bearing cup 66. Indeed, the surface 76 is the only non-axial surface of the cutter member 15 in contact with any other part of the can opener, so that all axial thrust imposed on the cutter wheel during a cutting operation is transmitted through the thrust surfaces 68 and 76. It will be noted that each of these thrust surfaces has a cross-sectional (plan) area equal to a major fraction of the corresponding axially-projected area of the cutter wheel, thus avoiding unduly large stresses on the cartridge body 60.

Reference is now made to FIG. 9, and FIGS. 4 to 6. The traction wheel 18 has a coaxial, generally-cylindrical first working surface 30 which rolls on the top of the can seam 26, and a second working surface 32. The surface 32 is adjacent to, and outwardly divergent from, the surface 30, and engages the chuck wall 34 of the can seam. Both of the surfaces 30 and 32 have a series of external knurls or flutes 80, to provide a friction drive whereby the can 28 is rotated about its own axis when the seam 26 is gripped between the traction wheel and the side abutment 56.

Figure 5:
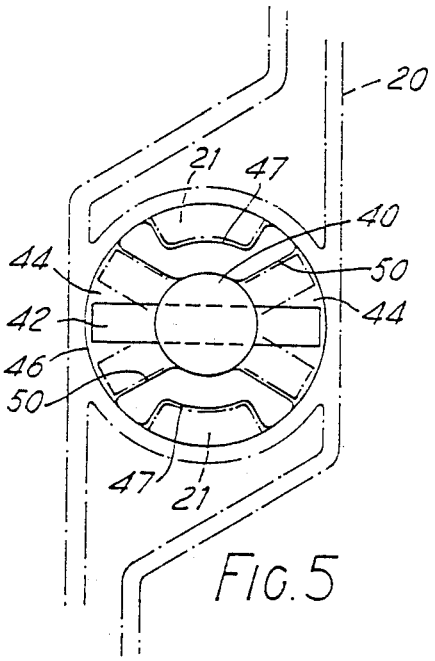
FIG. 5 is an end view of a camming mechanism through which the actuating butterfly key operates the can opener, seen from the left-hand side of FIG. 4.
Figure 6:
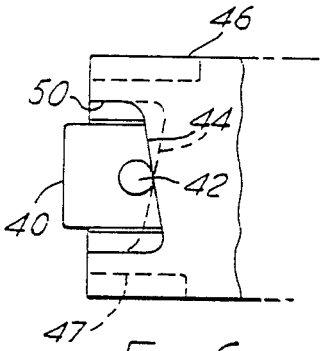
FIG. 6 is an unsectioned view of the same camming mechanism, corresponding to the sectioned view thereof seen in FIG. 4.

The traction wheel, driven by rotation of the actuating key 20, is coupled to the key through the camming mechanism seen in FIGS. 4 to 6, as follows. The traction wheel has an integral spindle 40, extending through the working head 14 and projecting some way out of the back of the housing so as to carry the key 20. A cam follower, in this example a pin 42, is mounted in the projecting part of the spindle 40, so as to project radially from the latter. The pin 42 is engaged by a pair of cam surfaces 44 formed on a cam hub 46, which is preferably of metal, and which is freely rotatable on the spindle 40. The cam hub may conveniently be of the same material as the cartridge body 60. The butterfly key 20 is mounted on the hub 46 by means of a pair of opposed internal lugs 21 which make a firm, but slidably releasable, push fit in a pair of opposed recesses 47 of the hub 46. Alternatively the key 20 may be permanently fixed to the cam hub in which case it may have an appropriate through hole to give access for knocking the pin out if it is required to dismantle the can opener. The pin 42 is preferably mounted in the spindle 40 with a light press fit to enable it to be removed when required.

Figure 9:
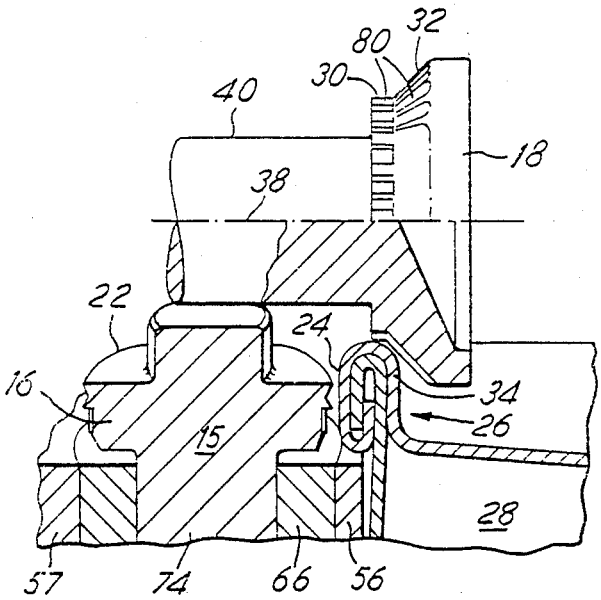
FIG. 9 is another, part-sectional, scrap elevation, taken on the line IX—IX in FIG. 3 and illustrating the engagement of a can seam with the traction wheel and cutter wheel of the can opener.

A compression spring 48 is mounted coaxially around the traction wheel spindle 40 so as to bear axially on the cam hub 46 and on the thrust surface 61, FIG. 4. The spring 48 may be in the form of a series of metallic disc springs, or in any other convenient form that provides sufficient capacity for axial compression: for example, a non-metallic material such as polyurethane rubber may be used. The arrangement allows limited axial movement of the cam hub 46 with respect to the housing 10, against the spring 48. In fact, the whole assembly of traction wheel, can hub and butterfly key is moved in this way, by rotation of the key in an appropriate (backward) direction, to a position indicated by phantom lines in FIG. 4. FIG. 9 shows the traction wheel in this position. When the key 20 is then rotated in the opposite (forward) direction, the cam surfaces 44 draw the pin 42 to the left as seen in FIG. 4. It can be seen by reference to FIG. 4 or FIG. 9 that the facility for axial movement of the traction wheel enables a can seam to be easily placed in position under the traction wheel, which is then drawn back so that the can is gripped firmly between the traction wheel 18 and the side abutment 56. As the key 20 is rotated forwardly, the cam surfaces 44 move past the pin 42 until the latter is engaged by a pair of driving faces 50 of the cam hub (FIGS. 5 and 6). This prevents further rotation of the key 20 relative to the traction wheel, so that further rotation of the key positively rotates the traction wheel through the driving faces 50 and pin 42.

The stiffness, the material, and the axial length of the spring 48, and the width of the gap 52 (FIG. 4) between the cam hub 46 and the working head 14, are so chosen as to allow the spring 48 always to be in some degree of compression when a can is engaged (thus ensuring that contact is maintained during a can opening operation between the cam surface 44 and pin 42), while permitting a desired range of thicknesses of can seams 26 to be accommodated.

Figure 11:
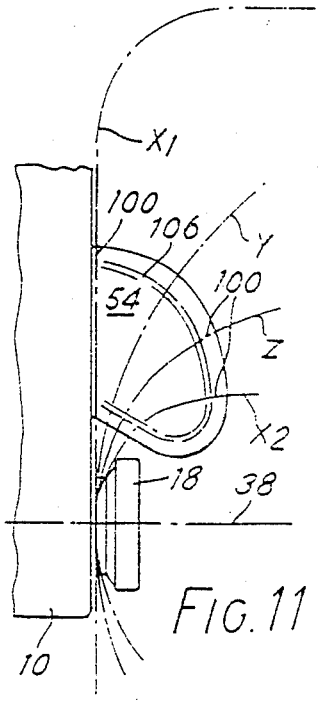
FIG. 11 illustrates how a first abutment, here in the form of a fin, enables the can opener to be employed with a variety of cans of different shapes and sizes.

Referring now to FIGS. 3 and 11, the reaction fin 54 in this example has a form similar to that of a human ear, and is formed with a bead 106 projecting downwardly as seen in FIG. 3. The under-surface of the bead 106 is a seam-engaging surface which spans a zone such as to define a multiplicity of possible points of contact at different distances from the traction wheel axis 38, and at different distances from the housing 10. Four such points of contact are indicated in FIG. 11 by the reference numeral 100, in connection with four respectively lines of contact $X_1$, $X_2$, Y and Z.

The line Y is the line of contact between the fin 54 and the end seam of a large cylindrical can, whilst the line Z is the same in respect of a cylindrical can of smaller diameter. The lines $X_1$ and $X_2$ relate to a so-called irregular, or generally-rectangular, can having sharply radiused corners. The line $X_1$ is the line of contact between the fin 54 and a straight side of this irregular can, during cutting of the seaming wall along that straight side. The line $X_2$ represents the situation whilst the seaming wall is being severed on a radiused corner of the same can.

It will be realised that the fin 54 may take a variety of shapes, provided that a number of points of contact, such as the points 100, at varying distances from both the axis 38 and the housing 10, can be obtained. This is most conveniently achieved, as in the fin 54, by making the seam-engaging surface (e.g. the underside of bead 106) generally curved outwardly and forwardly from the housing towards the axis 38 of the traction wheel.

In operation, the can opener is placed on a can to be opened, with the traction wheel 18 resting on the can seam 26, and the butterfly key 20 is turned backwards so as to allow the traction wheel to move axially outwardly, i.e. to the right as seen in FIG. 4, to the position indicated by phantom lines, so that the top of the seam engages the cylindrical working surface 30 of the traction wheel (FIG. 9). The key 20 is now turned in a forward direction, so causing the can opener to grip the can as already described, while forcing the seaming wall 24 into engagement with the cutter wheel 16. At the same time the can seam comes into locating engagement with the fin 54, and the side of the can bears against the side abutment 56. This situation is illustrated in FIGS. 3 and 4.

Further forward rotation of the key 20, as already mentioned, applies a positive driving torque to the traction wheel 18. The latter rotates the can about its own axis, and the can in its turn rotates the cutter wheel 16, with the assistance of the flutes 112 and teeth 114, FIG. 7. The rotating cutter wheel severs the seaming wall 24 in the manner described with reference to FIG. 10. On completion of the cutting operation, the can opener is released from the can by turning the key 20 backwards, after which the severed portion of the can end may be lifted from the body of the can.

The can opener can be assembled in the following order. The cutter member spindle 74 is inserted into the cup 66 which is then fitted into the cartridge body. When the traction wheel spindle 40 has been inserted through its bearing bore 62, the spring 48, cam hub 46, and lastly the pin 42, can be fitted. The cartridge can then be fitted into the housing 10 and the butterfly key 20 to the cam hub.

The can opener can readily be dismantled for cleaning, servicing, repair or for replacement of worn or damaged parts, particularly the cutter member 15, the cutter member bearing cup 66, and the traction wheel 18. The dismantling procedure is straightforward. After the key 20 and cartridge are removed from the housing 10, the pin 42 is knocked out and the cam hub 46 removed, whereupon the spring 48 can be taken off and the traction wheel 18 and its spindle withdrawn. Using a suitable tool applied through the knock-out hole 102, the bearing cup 66 is removed with the traction wheel 16. Re-assembly is the reverse of the above procedure.

Figure 12:
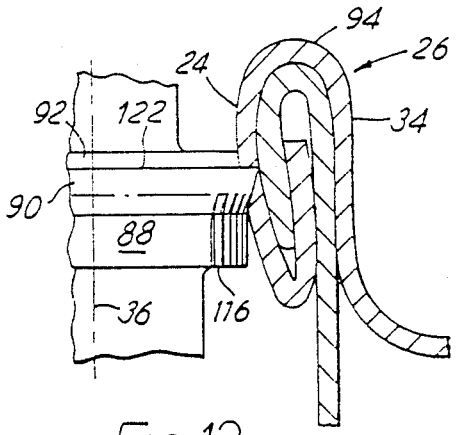
FIGS. 12 and 13 show a modified cutter wheel having a depth limiting shoulder, the action being illustrated with can seams of two different metal thicknesses.
Figure 13:
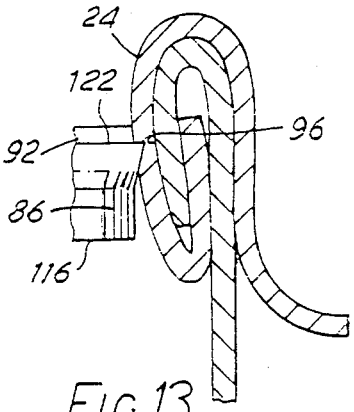

FIGS. 12 and 13 show a modified cutter wheel 116, which comprises a cylindrical portion 88 below a flared portion 90, which terminates in a cutting edge 122, and an integral, coaxial depth limiter 92 lying immediately above, and terminating in the same radial plane as, the cutting edge 122, but being of smaller diameter. Axial knurls or teeth 86, around the cylindrical portion 88 and extending into the flared portion 90, assist rolling friction between the cutter wheel 116 and the seaming wall 24. The cylindrical portion 92 limits the depth of penetration of the cutting edge 122 into the seaming wall 24. In FIG. 12, the seaming wall is very thin, and the depth limiter 92 allows the edge 122 to penetrate all the way through the seaming wall, whilst substantially preventing any penetration of the body hook 94. The seaming wall 24 in FIG. 13 is thicker so that the depth limiter 92 prevents the cutting edge 122 from completely severing the wall 24. However the uncut metal 96, which remains when the depth limiter comes into contact with the wall 24, is relatively thin. As the can is rotated about its axis, this uncut metal 96 is subjected to severe transverse shear stress applied by the cutter wheel 116 and traction wheel to the cover hook of the seam and therefore to the seaming wall 24. This shear stress is sufficient to rupture the thin section 96, thus severing the seaming wall 24.

Figure 14:
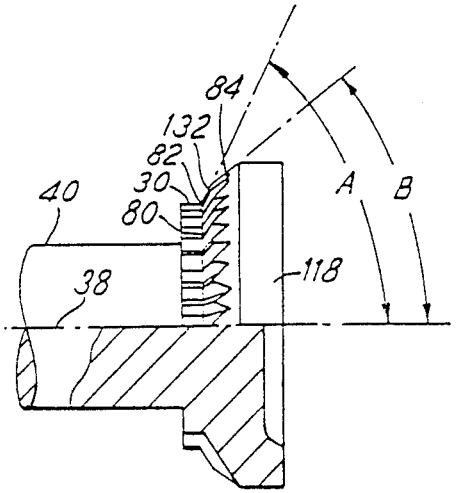
FIG. 14 shows a modified form of a traction wheel.

Referring to FIG. 14, in the modified traction wheel 118 shown therein, the chuck-wall engaging surface, 132, defines a first cone angle, of twice the angle indicated at A, with the axis 38 of the traction wheel from the junction 82 of the surface 132 with the cylindrical working surface 30. In addition, however, the surface 132 is relieved by having a bevelled portion 84, terminating at the outer end of the surface 132, remote from the junction 82. The bevelled portion 84 defines a second cone angle (of twice the angle indicated at B), which is smaller than the first-mentioned cone angle. Typically the angles A and B are of the order of 60° and 35° respectively, so that the cone angle of the bevelled portion 84 is about 70°, the other cone angle being about 120°. The bevelled portion 84 can improve the traction provided by the traction wheel, having regard to the fact that the cross-sectional profiles and dimensions of the double end seams of cans show considerable variation as between one can and another, and over the length of any one seam. This latter variation will for example occur at the side seam of a can of the "built-up" kind.

Figure 15:
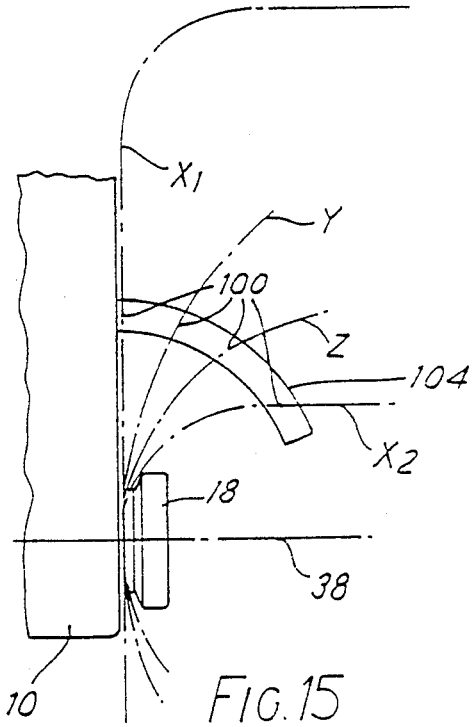
FIG. 15 shows a modification by way of a different form of first abutment.

Referring now to FIG. 15, the abutment here consists of a curved reaction pin 104 which is cantilevered from the housing 10, its lower surface constituting the seam-engaging surface in which the contact points 100 lie.

It should be stressed that the fin 54 (FIG. 11) and curved pin 104 (FIG. 15) represent but two examples of possible abutment elements for the purpose described herein.

The housing 10 may be of any suitable material, and is preferably formed by injection moulding a suitable plastics material. The housing and butterfly key may take any suitable shape suitable for the purpose for which the can opener is intended. A wheel or any other means for operating the can opener may be substituted for the butterfly key, including for example means for coupling the traction wheel spindle to a suitable drive means, powered electrically or otherwise.

We claim:

1. A can opener comprising: a housing; a cutter member comprising a cutter wheel having a circumferential cutting edge for severing a seaming wall of a double end seam of a can; a traction wheel defining a traction wheel axis and having a peripheral first surface, parallel to the traction wheel axis for engaging the top of the seam and a second surface diverging outwardly from the first surface, for engaging a chuck wall of the seam, means mounting each of said wheels rotatably in the housing with their axes substantially perpendicular to each other; actuating means for driving one of the said wheels; a first abutment projecting from the housing behind the wheels, with respect to the direction of movement of the housing relative to the seam during cutting, the said first abutment having a seam-engaging surface for engaging the top of the seam to tilt the housing about the traction wheel axis when said seam-engaging surface is engaged with the top of the seam, whereby to determine an angle of dive greater than zero between the planes of the said cutting edge and the top of the seam; a second abutment on said housing for engaging the side of the can during cutting; and a bearing member contained in a bore in the housing and having a first thrust surface, the cutter member having a terminal second thrust surface axially offset from the cutter wheel and bearing on said first thrust surface of the bearing member, said second thrust surface being the only non-axial surface of the cutter member in contact with any other part of the can opener, whereby all axial thrust imposed on the cutter wheel is transmitted through said thrust surfaces.

2. A can opener according to claim 1, comprising a cartridge having a body snugly mounted in the housing, the cutter member, traction wheel, and bearing member all being carried by the body of the cartridge.

3. A can opener according to claim 2, wherein the cartridge is replaceably removable from the housing, the cartridge having means whereby the cutter wheel and traction wheel can then be removed from the cartridge body for replacement.

4. A can opener according to claim 3, wherein the bearing member is a separate member mounted in an aperture of the cartridge body open at an external surface of the body, the body having a knock-out hole to enable the bearing member and the cutter member to be removed together after removal of the traction wheel.

5. A can opener according to claim 4, wherein the bearing member is in the form of a metallic cup.

6. A can opener according to claim 1, wherein the cutter wheel includes an integral, generally-cylindrical portion coaxial with, but of a diameter smaller than, the cutting edge, for limiting the depth of penetration of the cutting edge into the seaming wall.

7. A can opener according to claim 1, wherein the seam engaging surface of the first abutment is so shaped as to span a zone defining a multiplicity of possible points of contact at different distances from the traction wheel axis and at different distances from the housing.

8. A can opener according to claim 7, in which the first abutment is in the form of a fin.

9. A can opener according to claim 1, wherein the seam-engaging surface of the first abutment is so shaped as to span a zone defining a multiplicity of possible points of contact at different distances from the traction wheel axis and at different distances from the housing the first abutment being in the form of a curved pin, cantilevered from the housing and having a lower surface constituting the seam-engaging surface.

10. A can opener according to any one of the preceding claims wherein the seam-engaging surface of the first abutment is generally curved outwardly and forwardly from the housing towards the traction wheel axis.

11. A can opener comprising:

a housing;

a cartridge carried by the housing and comprising: a body snugly mounted in the housing; a cutter member carried by said body and including a cutter wheel having a circumferential cutting edge for severing a seaming wall of a double end seam of a can; a traction wheel carried by said body, defining a traction wheel axis and having a peripheral first surface parallel to said seam and a second surface diverging outwardly from said first surface, for engaging a chuck wall of the seam; means mounting each of said wheels rotatably in said body with their axes substantially perpendicular to each other; actuating means carried by said body for driving one of said wheels; and a bearing member located in said body and having a first thrust surface, the cutter member having a terminal second thrust surface axially offset from the cutter wheel and bearing on said first thrust surface of the bearing member, said second thrust surface being the only non-axial surface of the cutter member in contact with any other part of the can opener, whereby all axial thrust imposed of the cutter wheel is transmitted through said thrust surfaces;

a first abutment projecting from the housing behind said wheels, with respect to the direction of movement of the housing relative to said seam during cutting, and having a seam-engaging surface for engaging the top of said seam to tilt the housing about the traction wheel axis when said seam-engaging surface is engaged with the seam, to determine an angle of dive greater than the zero between the planes of said cutting edge and the top of the seam; and a second abutment on the housing for engaging the side of the can during cutting.

12. A can opener according to claim 11, wherein the housing has means mounting the cartridge replaceably removable therefrom, the cartridge having means whereby the wheels can then be removed from said body for replacement.

13. A can opener according to claim 12, wherein the said body has an aperture open at an external surface of the body, said bearing member being a separate member mounted in said aperture, said body further having a knock-out hole to enable said bearing member and cutter member to be removed together after removal of the traction wheel.

14. A can opener according to claim 13, wherein said bearing member is in the form of a metallic cup.

15. A can opener according to claim 11, wherein the cutter wheel includes an integral, generally-cylindrical portion coaxial with, but of smaller diameter than, the cutting edge, for limiting the depth of penetration of the cutting edge into the seam wall.

16. A can opener comprising: a housing; a cutter member comprising a cutter wheel having a circumferential cutting edge for severing a seam wall of a double end seam of a can; a traction wheel having a peripheral first surface parallel to the traction wheel axis for engaging the top of the seam and a second surface diverging outwardly from the first surface, for engaging a chuck wall of the seam, the wheels being rotatably mounted in the housing with their axes substantially perpendicular to each other; actuating means for driving one of the wheels; a first abutment projecting from the housing behind the wheels, with respect to the direction of the movement of the housing relative to the seam during cutting, said first abutment having a seam-engaging surface for engaging the top of the seam to tilt the housing about the traction wheel axis when the said seam-engaging surface is engaged with the top of the seam, whereby to determine an angle of dive greater than zero between the planes of said cutting edge and the top of the seam; a second abutment on the housing for engaging the side of a can during cutting; and a bearing member located in a bore in the housing and having a thrust surface; the cutter member having a terminal thrust surface axially offset from the cutter wheel and bearing on said thrust surface of the bearing member; said terminal thrust surface being the only non-axial surface of the cutter member in contact with any other part of the can opener, whereby all axial thrust imposed on the cutter wheel is transmitted through said thrust surfaces; and a cartridge having a body snugly mounted in the housing, the cutter member and traction wheel both being carried by the body of the cartridge, and wherein the cartridge is replaceably removable from the housing, the cartridge having means whereby the cutter wheel and traction wheel can be removed from the cartridge body for replacement.

17. A can opener according to claim 16, wherein the bearing member is a separate member mounted in an aperture of the cartridge body open at an external surface of the body, the body having a knock-out hole to enable the bearing member and the cutter member to be removed together after removal of the traction wheel.

18. A can opener according to claim 17 wherein the bearing member is in the form of a metallic cup.

19. A can opener comprising: a housing; a cutter member comprising a cutter wheel having a circumferential cutting edge for severing a seaming wall of a double end seam of a can; a traction wheel having a peripheral first surface parallel to the traction wheel axis for engaging the top of the seam and a second surface diverging outwardly from the first surface for engaging a chuck wall of the seam, the wheels being rotatably mounted in the housing with their axes substantially perpendicular to each other; actuating means for driving one of the wheels; a first abutment projecting from the housing behind the wheels, with respect to the direction of movement of the housing relative to the seam during cutting, the first abutment having a seam-engaging surface for engaging the top of the seam to tilt the housing about the traction wheel axis when said seam-engaging surface is engaged with the top of the seam, whereby to determine an angle of dive greater than zero between the planes of said cutting edge and the top of the seam; and a second abutment on the housing for engaging the side of the can during cutting; the cutter member having a terminal thrust surface axially offset from the cutter wheel and bearing on said thrust surface, the said terminal thrust surface being the only non-axial surface of the cutter member in contact with any other part of the can opener, whereby all axial thrust imposed on the cutter wheel is transmitted through said thrust surfaces, wherein the seam-engaging surface of the first abutment is so shaped as to span a zone defining a multiplicity of possible points of contact at different distances from the traction wheel axis and at different distances from the housing; the first abutment being in the form of a curved finer pin cantilevered from the housing and having a lower surface constituting the seam-engaging surface.

* * * * *

UNITED STATES PATENT AND TRADEMARK OFFICE

CERTIFICATE OF CORRECTION

PATENT NO. : 4,782,594

DATED : November 8, 1988

INVENTOR(S) : Paul Porucznik et al

It is certified that error appears in the above-identified patent and that said Letters Patent is hereby corrected as shown below:

On the title page assignee should read

--(73) Assignee: Metal Box Public Limited Company--..

Column 2, line 33, change "sungly" to -- snugly --.

Signed and Sealed this

Fourth Day of July, 1989

*Attest:*

DONALD J. QUIGG

*Attesting Officer*

*Commissioner of Patents and Trademarks*